US011781278B2

(12) United States Patent
Wolfrum et al.

(10) Patent No.: US 11,781,278 B2
(45) Date of Patent: Oct. 10, 2023

(54) UNBALANCE ARRANGEMENT FOR A COMPACTOR ROLLER OF A SOIL COMPACTOR

(71) Applicant: Hamm AG, Tirschenreuth (DE)

(72) Inventors: Gerhard Wolfrum, Waldershof (DE); Peter Jänner, Krummennaab (DE)

(73) Assignee: HAMM AG, Tirschenreuth (DE)

( * ) Notice: Subject to any disclaimer, the term of this patent is extended or adjusted under 35 U.S.C. 154(b) by 277 days.

(21) Appl. No.: 17/232,269

(22) Filed: Apr. 16, 2021

(65) Prior Publication Data

US 2021/0332548 A1 Oct. 28, 2021

(30) Foreign Application Priority Data

Apr. 22, 2020 (DE) ..... 10 2020 110 952.0

(51) Int. Cl.
*E02D 3/00* (2006.01)
*E02D 3/074* (2006.01)

(52) U.S. Cl.
CPC ..... *E02D 3/074* (2013.01)

(58) Field of Classification Search
CPC ..... E02D 3/074
USPC ..... 404/113, 117
See application file for complete search history.

(56) References Cited

U.S. PATENT DOCUMENTS 3,722,380 A * 3/1973 Kaltenegger ..... E01C 19/283 404/117
4,389,137 A * 6/1983 Riedl ..... E02D 3/074 74/61
5,788,408 A * 8/1998 Mitsui ..... E01C 19/286 404/117

(Continued)

FOREIGN PATENT DOCUMENTS

| | | |
|---|---|---|
| DE | 29601 | 3/1965 |
| DE | 1267623 | 5/1968 |
| WO | 03/097940 | 11/2003 |

OTHER PUBLICATIONS

German Search Report filed in 10 2020 110 952.0 dated Mar. 2, 2021.

(Continued)

*Primary Examiner* — Raymond W Addie
(74) *Attorney, Agent, or Firm* — RANKIN, HILL & CLARK LLP

(57) ABSTRACT

An unbalance arrangement for a compactor roller of a soil compacter includes a first unbalance mass unit rotatable around an unbalance axis of rotation having a first center of mass eccentric with respect to the unbalance axis of rotation, a second unbalance mass unit rotatable around the unbalance axis of rotation having a second center of mass eccentric with respect to the unbalance axis of rotation, an unbalance drive for jointly driving the first unbalance mass unit and the second unbalance mass unit to rotate around the unbalance axis of rotation, and a phase position adjustment unit for (Continued)

adjusting a phase position of the first center of mass with respect to the second center of mass around the unbalance axis of rotation. The phase position adjustment unit includes a spur gear arrangement in the torque transmission path between the unbalance drive and the first unbalance mass unit or the second unbalance mass unit.

20 Claims, 10 Drawing Sheets

(56) References Cited

U.S. PATENT DOCUMENTS

| | | | | |
|---|---|---|---|---|
| 6,717,379 | B1 * | 4/2004 | Andersson | E01C 19/38 404/117 |
| 2004/0120767 | A1 * | 6/2004 | Potts | B06B 1/16 404/117 |
| 2008/0267707 | A1 * | 10/2008 | Potts | E01C 19/288 404/117 |
| 2012/0301221 | A1 * | 11/2012 | Ackermann | E01C 19/286 404/117 |

OTHER PUBLICATIONS

European Search Report filed in EP 21 16 3305 dated Jul. 6, 2021.

* cited by examiner

UNBALANCE ARRANGEMENT FOR A COMPACTOR ROLLER OF A SOIL COMPACTOR

The present invention relates to an unbalance arrangement for a compactor roller of a soil compactor, comprising a first unbalance mass unit rotatable around an unbalance axis of rotation having a first center of mass eccentric with respect to the unbalance axis of rotation, a second unbalance mass unit rotatable around the unbalance axis of rotation having a second center of mass eccentric with respect to the unbalance axis of rotation, an unbalance drive for jointly driving the first unbalance mass unit and the second unbalance mass unit to rotate around the unbalance axis of rotation, and a phase position adjustment unit for adjusting a phase position of the first center of mass with respect to the second center of mass around the unbalance axis of rotation.

Such an unbalance arrangement is known from DE 102 35 976 A1. In this known unbalance arrangement, one of the two unbalance mass units is coupled to the drive shaft of an unbalance drive and can be driven directly by this to rotate around an unbalance axis of rotation. The other of the two unbalance mass units is drivable by the unbalance drive to rotate around the unbalance axis of rotation via a phase position adjustment unit designed as a planetary gear. In order to be able to adjust the phase position, i.e., the angular position, of the centers of mass of the two unbalance mass units around the unbalance axis of rotation with respect to one another, the phase position adjustment unit designed as a planetary gear has an input ring gear and an output ring gear. A plurality of planetary gear units following one another in the circumferential direction each have an input planetary gear which is in meshing engagement with the input ring gear and an input sun gear that is drivable to rotate by the unbalance drive, and has an output planetary gear that is in meshing engagement with the output ring gear and an output sun gear coupled to the other unbalance mass unit for joint rotation.

It is the object of the present invention to provide an unbalance arrangement for a compactor roller of a soil compactor, which can reliably transmit large torques with a compact and easy-to-implement structure.

According to the invention, this object is achieved by an unbalance arrangement for a compactor roller of a soil compactor, comprising:

- a first unbalance mass unit rotatable around an unbalance axis of rotation having a first center of mass eccentric with respect to the unbalance axis of rotation,
- a second unbalance mass unit rotatable around the unbalance axis of rotation having a second center of mass eccentric with respect to the unbalance axis of rotation,
- an unbalance drive for jointly driving the first unbalance mass unit and the second unbalance mass unit to rotate around the unbalance axis of rotation,
- a phase position adjustment unit for adjusting a phase position of the first center of mass with respect to the second center of mass around the unbalance axis of rotation.

The unbalance arrangement according to the invention is characterized in that the phase position adjustment unit comprises a spur gear arrangement in the torque transmission path between the unbalance drive and the first unbalance mass unit or the second unbalance mass unit. Since, in the unbalance arrangement constructed according to the invention, the phase position adjustment unit comprises a spur gear arrangement, i.e., a gear arrangement in which all gearwheels that have a drive connection or meshing engagement with one another are designed as spur gears, a structure can be implemented using standard components which is suitable for transmitting large torques. The use of ring gears, which are generally very complex to manufacture, as is essential in planetary gears, is not necessary. It is also not necessary to provide a comparatively large number of planetary gears, which are required in order to be able to reliably transmit the torques occurring in such unbalance arrangements.

It should be noted that in terms of the present invention, spur gears are gearwheels which have gear teeth on their outer circumference having teeth protruding radially outward and which have a drive connection to other spur gears in that the gear teeth of these spur gears are in meshing engagement and thus spur gears in meshing engagement with one another rotate in opposite directions, or that an endless transmission element, such as a toothed belt or a chain, is engaged with the gear teeth of these spur gears and thus spur gears that have a drive connection to one another rotate in the same direction.

The spur gear arrangement can comprise a gear input spur gear that is drivable by the unbalance drive to rotate around a gear axis of rotation, a gear output spur gear rotatable around the gear axis of rotation and a group of gear adjustment spur gears in meshing engagement with the gear input spur gear and the gear output spur, wherein the gear adjustment spur gears are rotatably supported on an adjustment spur gear carrier, and wherein the adjustment spur gear carrier is rotatable with respect to the gear input spur gear and the gear output spur gear around the gear axis of rotation. The rotation or pivoting of the adjustment spur gear carrier around the gear axis of rotation forces a relative rotation between the gear input spur gear and the gear output spur gear and thus a change in the phase position of the centers of mass of the two unbalance mass units with respect to one another.

In order to achieve this pivoting of the adjustment spur gear carrier around the gear axis of rotation, the adjustment spur gear carrier can be assigned an adjustment spur gear carrier drive for pivoting the adjustment spur gear carrier around the gear axis of rotation. Such an adjustment spur gear carrier drive can comprise a drive motor which acts on the adjustment spur gear carrier, for example via a crank drive, a worm gear drive, a rack drive, or a gearwheel drive, in particular a spur gear drive.

For a structurally simple embodiment, it is proposed that the gear axis of rotation corresponds to the unbalance axis of rotation.

For torque transmission coupling of the gear input spur gear to the gear output spur gear, the group of adjustment spur gears can comprise a first adjustment spur gear that is rotatable around a first adjustment spur gear axis of rotation that is parallel to the gear axis of rotation and is in meshing engagement with the gear input spur gear, and a second adjustment gear wheel that is rotatable around a second adjustment spur gear axis of rotation that is parallel to the gear axis of rotation and is in meshing engagement with the first adjustment spur gear and the gear output spur gear.

In an embodiment variant of an unbalance arrangement according to the invention, the gear output spur gear can be coupled to the second unbalance mass unit for joint rotation.

To assist a uniform weight distribution of a compactor roller in the direction of a roller axis of rotation of the same, it is proposed that the gear input spur gear be drivable to rotate using the unbalance drive via the first unbalance mass unit, and/or that the first unbalance mass unit and the second unbalance mass unit are arranged axially between the unbalance drive and the phase position adjustment unit.

For such a distribution of the weight in the direction of the roller axis of rotation, the first unbalance mass unit can be coupled in a first axial end region to the unbalance drive for driving the first unbalance mass unit to rotate around the unbalance axis of rotation, and the first unbalance mass unit can have a drive connection in a second axial end region by means of a gear transmission unit to the gear input spur gear.

The gear transmission unit can comprise:

a transmission drive spur gear coupled to the second axial end region of the first unbalance mass unit for joint rotation around the unbalance axis of rotation, a first transmission idler spur gear on a transmission shaft rotatable around a transmission axis of rotation parallel to the unbalance axis of rotation, wherein the first transmission idler spur gear has a drive connection to the transmission drive spur gear, a second transmission idler spur gear on the transmission shaft, wherein the second transmission spur gear has a drive connection to the gear input spur gear.

In order to ensure that the first transmission spur gear and the transmission drive spur gear rotate in the same direction of rotation, the first transmission idler spur gear can have a drive connection to the transmission drive spur gear by means of an endless transmission element and/or at least one connecting spur gear. If, for example, a single connecting spur gear in meshing engagement with the first transmission spur gear and the transmission drive spur gear is used, it is similarly ensured that the first transmission spur gear and the transmission drive spur gear rotate in the same direction of rotation. A plurality of connecting spur gears forming a gear train can also be used to establish the drive connection.

The second transmission idler spur gear can be in meshing engagement with the transmission input spur gear so that these two spur gears rotate in opposite directions to one another.

The endless transmission element can comprise a toothed belt or a drive chain for a slip-free transmission of the torque. Furthermore, it can be provided for this purpose that the first transmission idler spur gear and the second transmission idler spur gear are supported in a rotationally-fixed manner on the transmission shaft.

In an alternative embodiment of an unbalance arrangement, the transmission input spur gear can have a drive connection to a motor drive spur gear in order to introduce a drive torque.

In order to provide the required direction of rotation for the gear input spur gear so that the two unbalance mass units rotate in the same direction of rotation, it is proposed that the gear input spur gear be in meshing engagement with the motor drive spur gear. The motor drive spur gear can be provided on a drive shaft of the unbalance drive.

In order to also be able to conduct the drive torque to the first unbalance mass unit in this embodiment, the first unbalance mass unit can have a drive connection to the motor drive spur gear by means of a gear transmission unit.

The gear transmission unit can comprise:

a first transmission idler spur gear on a transmission shaft rotatable around a transmission axis of rotation parallel to the unbalance axis of rotation, wherein the first transmission idler spur gear has a drive connection to the motor spur gear, a second transmission idler spur gear on the transmission shaft, a transmission output spur gear coupled to the first unbalance mass unit for joint rotation around the unbalance axis of rotation, wherein the transmission output spur gear has a drive connection to the second transmission idler spur gear.

To achieve the required direction of rotation of the first unbalance mass unit, it is proposed that the first transmission idler spur gear be in meshing engagement with the motor drive spur gear, and/or that the second transmission idler spur gear be in meshing engagement with the transmission output spur gear.

For a reliable torque transmission in the gear transmission unit, the first transmission idler spur gear and the second transmission idler spur gear can be supported in a rotationally-fixed manner on the transmission shaft.

For an axially compact design, the unbalance drive and the phase position adjustment unit can be arranged on the same axial side with respect to the first unbalance mass unit and the second unbalance mass unit.

The present invention furthermore relates to a compactor roller for a soil compactor, comprising a roller shell surrounding a roller axis of rotation, wherein an unbalance arrangement constructed according to the invention is provided in a roller interior.

In order to be able to operate the compactor roller as a vibratory roller, in which a periodic force acting essentially orthogonally to the roller axis of rotation is exerted on the compactor roller by the unbalance arrangement, it is proposed that the roller axis of rotation corresponds to the unbalance axis of rotation.

The present invention further relates to a soil compactor, comprising at least one compactor roller constructed according to the invention and rotatably supported on a compactor frame around a roller axis of rotation.

The present invention is described in detail below with reference to the accompanying figures. In the figures.

Figure 1:
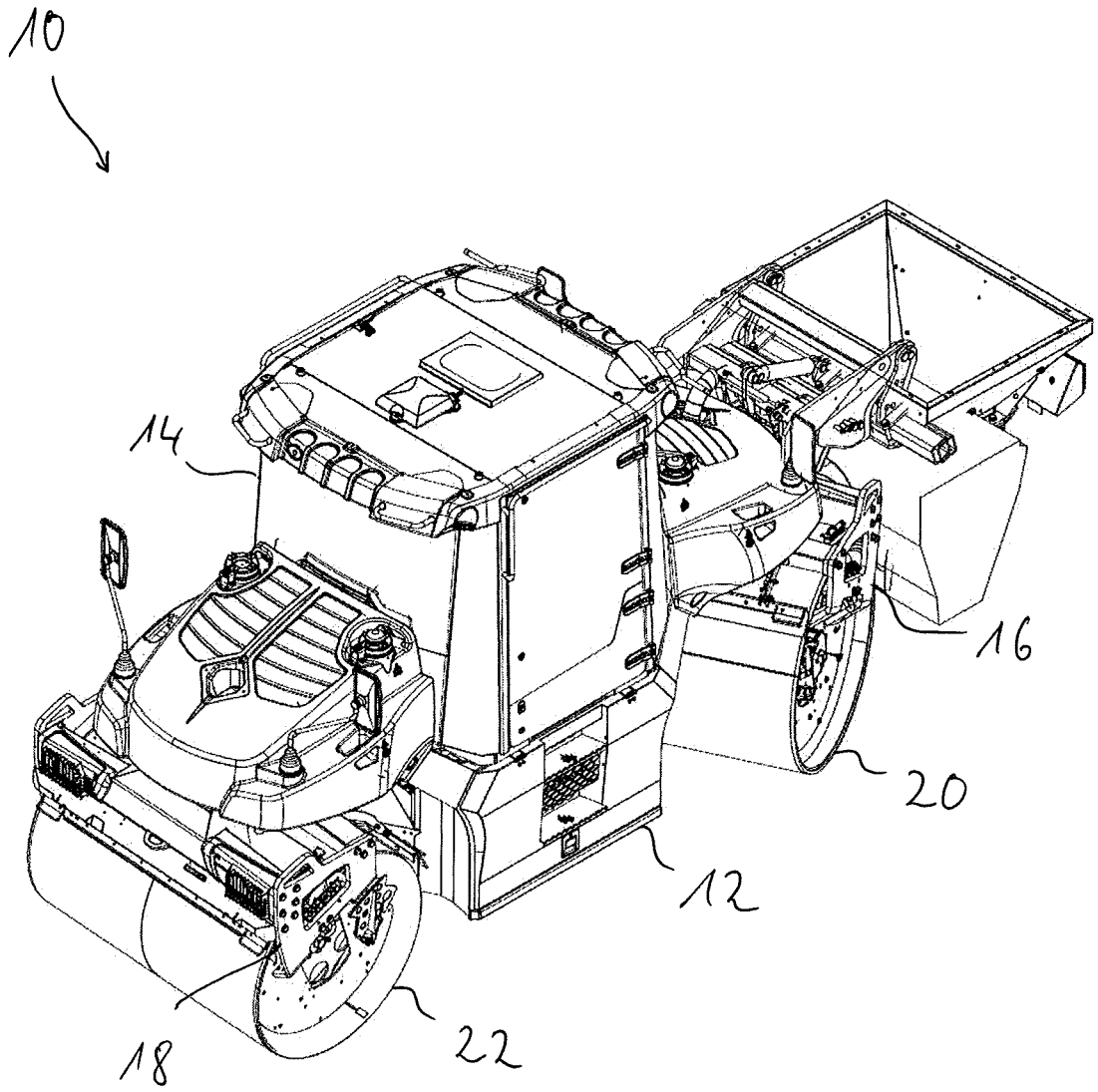
FIG. 1 shows a perspective view of a soil compactor with two compactor rollers.

In FIG. 1, a soil compactor is generally designated with 10. The soil compactor 10 comprises a cabin 14 on a central machine frame 12 in which an operator can sit. A front machine frame 16 and a rear machine frame 18 are pivotably supported on the central machine frame 12. On the front machine frame 16 and on the rear machine frame 18, a respective compactor roller 20, 22 is rotatably supported around a roller axis of rotation. The front machine frame 16 and the rear machine frame 18 as well as the compactor rollers 20, 22 rotatably supported thereon can be essentially structurally equivalent to one another and are explained below with reference to FIG. 2 by way of example based on the rear machine frame 18 or the compactor roller 22 rotatably supported thereon around a roller axis of rotation W.

It is to be noted that the soil compactor 10 can have a wide variety of designs and, for example, can also have only one such compactor roller, for example in the front region thereof, while a plurality of rubber wheels can then be provided in the rear region of the soil compactor 10. The structure of a compactor roller explained below can in principle be implemented independently of the design of the soil compactor 10.

The compactor roller 22 comprises a roller jacket 24 which surrounds the roller axis of rotation W and which surrounds a roller interior 26. On side frame parts 28, 30 of the rear machine frame 18, the compactor roller 22 is rotatably supported around the roller axis of rotation W. To drive the soil compactor 10, the compactor roller 22 can be assigned a traction drive motor 23, for example a hydraulic motor.

Figure 2:
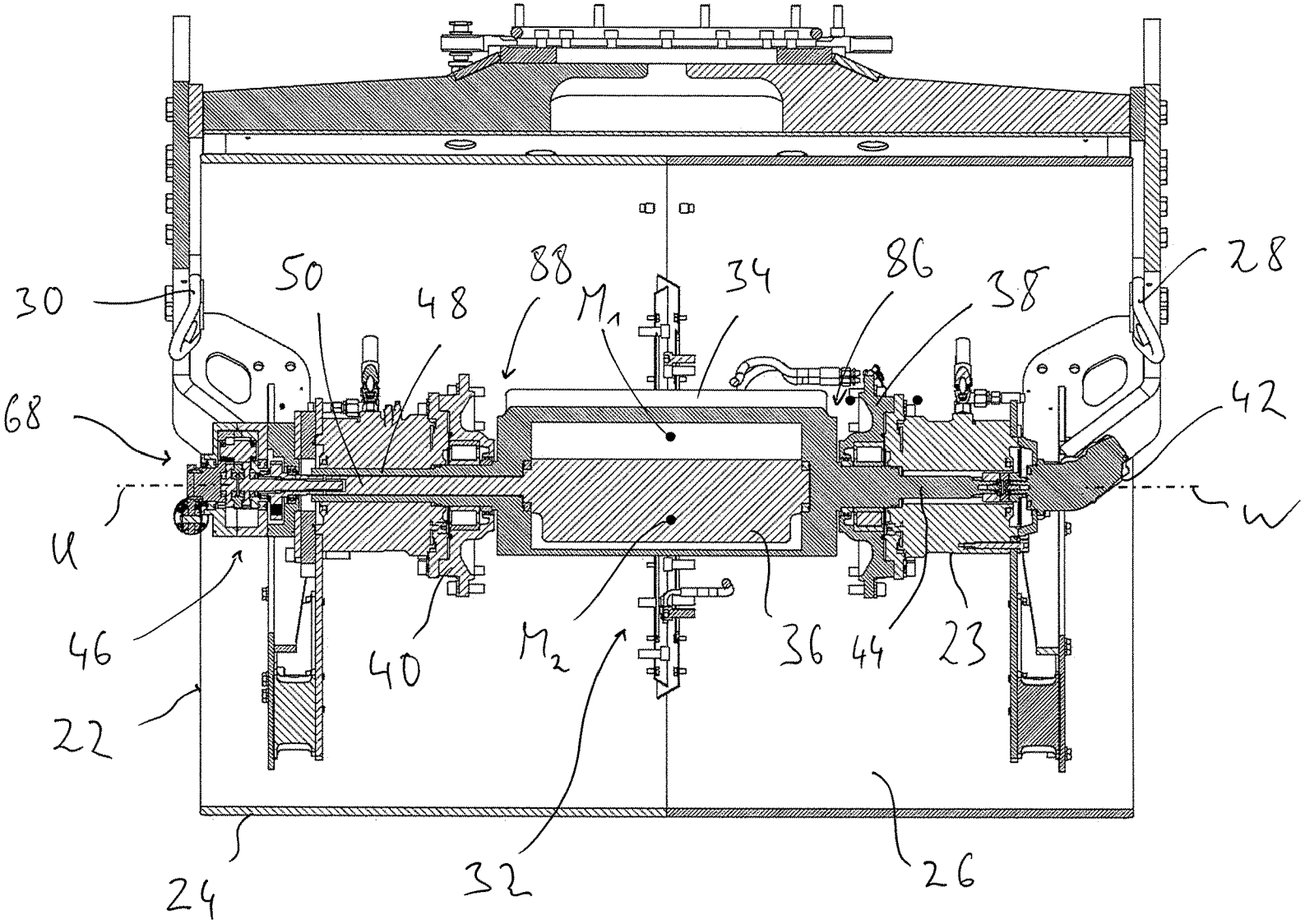
FIG. 2 shows a sectional view of a compactor roller of the soil compactor of FIG. 1 rotatably supported on a machine frame, having an unbalance arrangement arranged in the compactor roller.

An unbalance arrangement, generally designated with 32, is provided in the roller interior 26. The unbalance arrangement 32 comprises two unbalance mass units 34, 36 rotatable around an unbalance axis of rotation U, each having a center of mass $M_1$, $M_2$ eccentric relative to the unbalance axis of rotation U, which corresponds to the roller axis of rotation W. The two unbalance mass units 34, 36 are arranged in relation to one another in such a way that their centers of mass $M_1$, $M_2$ are positioned in the same axial region, in particular an axial center region of the compactor roller 22. As can be seen in FIG. 2, for example, the first unbalance mass unit 34 can be rotatably supported in the compactor roller 22 on suspensions 38, 40 supported therein, and the second unbalance mass unit 36 can be received in the first unbalance mass unit 34 and rotatably supported thereon.

The unbalance arrangement 32 is assigned an unbalance drive 42. This unbalance drive 42, designed as a hydraulic motor, for example, is coupled to a shaft section 44 extending from the first unbalance mass unit 34 for joint rotation and thus drives the first unbalance mass unit 34 directly to rotate around the unbalance axis of rotation U or the roller axis of rotation W. In this sense, direct means that no gear arrangement or the like that transmits the torque is provided between a drive shaft of the unbalance drive 42 and the shaft section 44 or the first unbalance mass unit 34.

The second unbalance mass unit 36 is driven by the unbalance drive 42 via the first unbalance mass unit 34 and a phase position adjustment unit, generally designated with 46, to rotate around the unbalance axis of rotation U. The phase position adjustment unit 46 is coupled on the drive side to a hollow shaft section 48 of the first unbalance mass unit 34 and on the output side to a shaft section 50 of the second unbalance mass unit 36 penetrating the hollow shaft section 48.

By means of the phase position adjustment unit 46, not only is the drive torque of the unbalance drive 42 transmitted via the first unbalance mass unit 34 to the second unbalance mass unit 36, but the phase position adjustment unit 46 can also be operated to adjust the phase position of the centers of mass $M_1$, $M_2$ of the two unbalance mass units 34, 36 around the unbalance axis of rotation U with respect to one another, which means that the angular distance of the two centers of mass $M_1$, $M_2$ around the unbalance axis of rotation U can be adjusted with respect to one another. The adjustment range is preferably 180°, so that, starting from the state shown in FIG. 2, in which the two centers of mass $M_1$, $M_2$ have an angular distance of 180° from one another and thus the unbalances provided by the two unbalance mass units 34, 36 compensate for one another, the angular distance can be reduced to zero, so that the two centers of mass $M_1$, $M_2$ have the same phase position with respect to one another and the unbalance arrangement 32 provides a maximum unbalance. Since the unbalance arrangement 32 is positioned in such a way that the unbalance mass units 34, 36 are driven by the unbalance drive 42 to rotate around the roller axis of rotation V, the rotating unbalance mass units 34, 36 basically generate a force that is essentially orthogonal to the roller axis of rotation W, so that a vibration acceleration is generated for the compactor roller 42, by means of which it is periodically accelerated accordingly in the direction of the underlying surface to be compacted or away from it.

The structure of the phase position adjustment unit 46 is described in detail below with reference to FIGS. 3 to 5.

The phase position adjustment unit 46 has on the input side a spline section 52 which can be coupled to the hollow shaft section 48 of the first unbalance mass unit 34 for joint rotation around the unbalance axis of rotation U. A transmission drive spur gear 54 of a gear transmission unit, generally designated with 56, is connected to the spline section 52 in a rotationally-fixed manner. The gear transmission unit 56 further comprises a first transmission idler spur gear 60 and a second transmission idler spur gear 62 on a transmission shaft 58. The two transmission idler spur gears 60, 62 are each supported in a rotationally-fixed manner on the transmission shaft 58 and are rotatable with it around a gear axis of rotation Ue. It is to be noted that in the example shown, the two transmission idler spur gears 60, 62 are arranged at an axial distance from one another. Similarly, these could be designed as respective gearwheel sections of an idler spur gear that is continuously formed in the direction of the transmission shaft 58 or that provides it.

The first transmission idler spur gear 60 has a drive connection to the transmission drive spur gear 54 via an endless transmission element 64, designed here as a toothed belt. The second transmission idler spur gear 62 is in meshing engagement with a gear input spur gear 66 of a spur gear arrangement, generally designated with 68, of the phase position adjustment unit 46 and is thus has a drive connection thereto. A gear output spur gear 70 of the spur gear arrangement 68 is rotationally fixed with a further spline section 72, which in turn can be coupled to the shaft section 50 of the second unbalance mass unit 36 for joint rotation. It is to be pointed out that the phase position adjustment unit 46 can be coupled to the first unbalance mass unit 34 or the second unbalance mass unit 36 on the input side as well as on the output side in a manner other than by the spline sections 52, 72.

The spur gear arrangement 68 comprises a group of gear adjustment spur gears 78, 80 on a cassette-like housing 74, which is pivotably supported in a housing 76 of the phase position adjustment unit 76 around a gear axis of rotation G. In the illustrated exemplary embodiment, the gear axis of rotation G corresponds to the unbalance axis of rotation U and thus also to the roller axis of rotation W. To pivot the housing 74 of the housing 74 providing an adjustment spur gear carrier 82, as shown in the illustrated exemplary embodiment, a positioning lever mechanism 84 actuated, for example, by a hydraulic cylinder, a rack drive, a worm gear drive, or the like can be used, the pivot of which around the gear axis of rotation G results in a corresponding pivot of the adjustment spur gear carrier 82 around the gear axis of rotation G.

The group of gear adjustment spur gears 78, 80 comprises a first gear adjustment spur gear 78 rotatably supported around a first adjustment spur gear axis of rotation $V_1$ on the adjustment spur gear carrier 82 and comprises a second gear adjustment spur gear 80 rotatably supported on the adjustment spur gear carrier 82 around a second adjustment spur gear axis of rotation $V_2$ The two gear adjustment spur gears 78, 80 are axially offset from one another, so that the first gear adjustment spur gear 78 is in meshing engagement with a gear teeth section thereof with the gear input spur gear 66 and is in meshing engagement with another gear teeth section thereof with the second gear adjustment spur wheel 80. The second gear adjustment spur gear 80 is in turn in meshing engagement with a further gear teeth section thereof with the gear output spur gear 70. It is to be noted that in the illustrated exemplary embodiments, the two gear adjustment spur gears 78, 80 are designed as spur gears continuously having these gear teeth sections. The gear adjustment spur gears 78, 80 could similarly also be formed by gearwheel sections axially separated from one another and supported in a rotationally-fixed manner on a respective shaft.

If the unbalance arrangement 32 is to be excited during operation in order to set the compactor roller 22 into vibration, the unbalance drive 42 drives the first unbalance mass unit 34 to rotate around the unbalance axis U. The first unbalance mass unit 34 rotating around the unbalance axis of rotation U drives the second unbalance mass unit 36 to rotate around the unbalance axis of rotation U via the phase position adjustment unit. The design of the gear transmission unit 56 and the spur gear arrangement 68 ensures that the two unbalance mass units 34, 36 coupled to one another via the phase position adjustment unit 46 basically rotate in the same direction of rotation and at the same speed as one another around the unbalance axis of rotation U and thus also the roller axis of rotation W. When the adjustment spur gear carrier 82 is held in place, the phase position of the centers of mass $M_1$, $M_2$ does not change.

If the phase position of the two centers of mass $M_1$, $M_2$ with respect to one another is to be changed, the positioning lever mechanism 84 and with it the adjustment spur gear carrier 82 are pivoted around the gear axis of rotation G. This forces a relative rotation between the gear input spur gear 66 and the gear output spur gear 70. Due to the dimensioning of the various spur gears of the spur gear arrangement 68, a movement translation takes place, so that a pivot of the adjustment spur gear carrier 82 around the gear axis of rotation G by an angle of 90° results in a relative rotation between the gear input spur gear 66 and the gear output spur gear 70 by 180°, so that the centers of mass $M_1$, $M_2$ of the two unbalance mass units 34, 36 experience a change in the phase position or the angular position in relation to one another in an angular range of 180° when the adjustment gear carrier 82 is pivoted in an angular range of 90°, so that it is possible to adjust continuously between the maximum unbalance effect and the minimum or nonexistent unbalance effect. This adjustment can be triggered by the operator who is seated in the cabin 14, depending on the underlying surface to be compacted and/or the degree of compaction of the underlying surface to be compacted by a corresponding actuating element.

Figure 3:
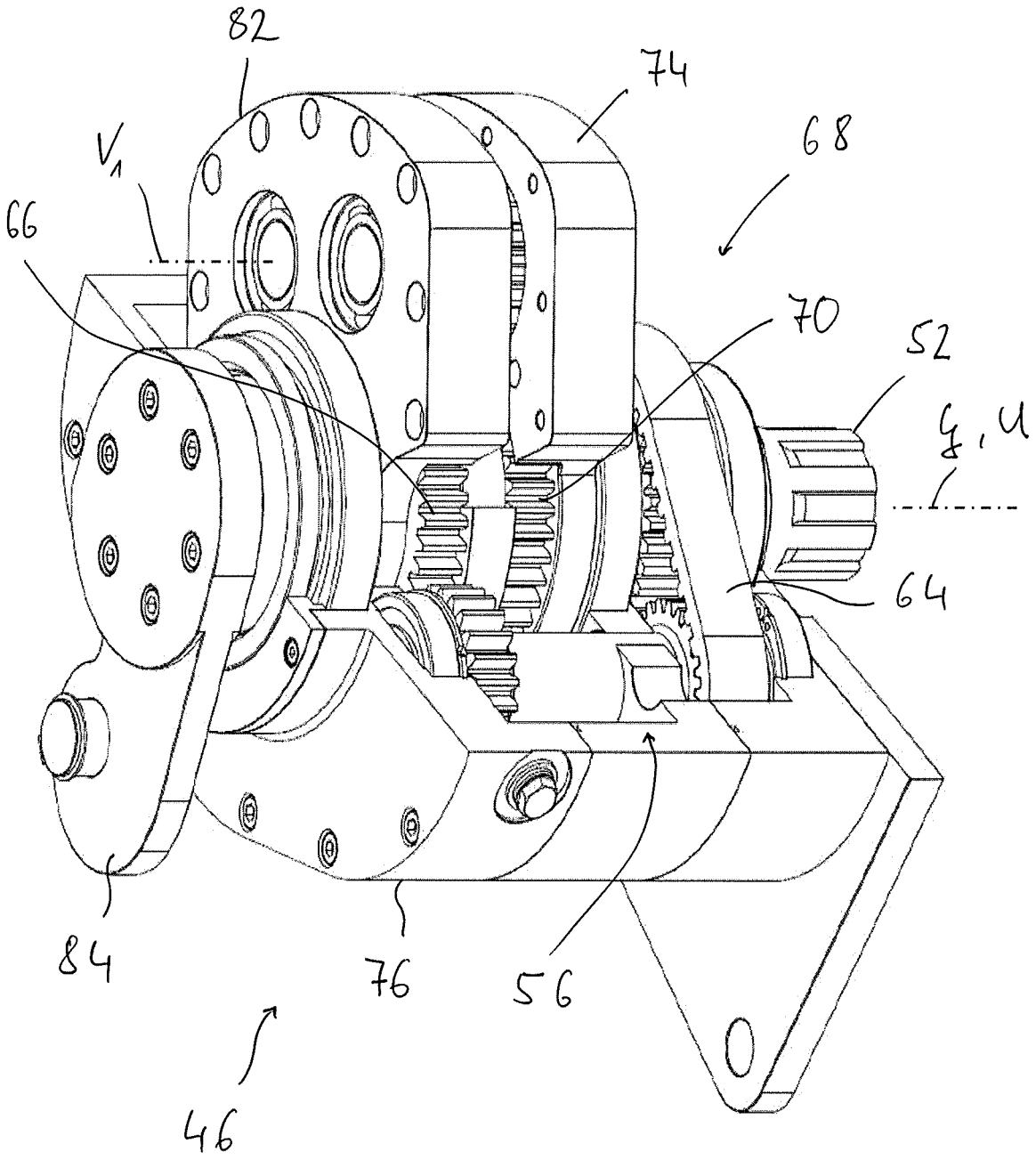
FIG. 3 shows a partially cut away perspective view shown a phase position adjustment unit of the unbalance arrangement of the compactor roller of FIG. 2.
Figure 4:
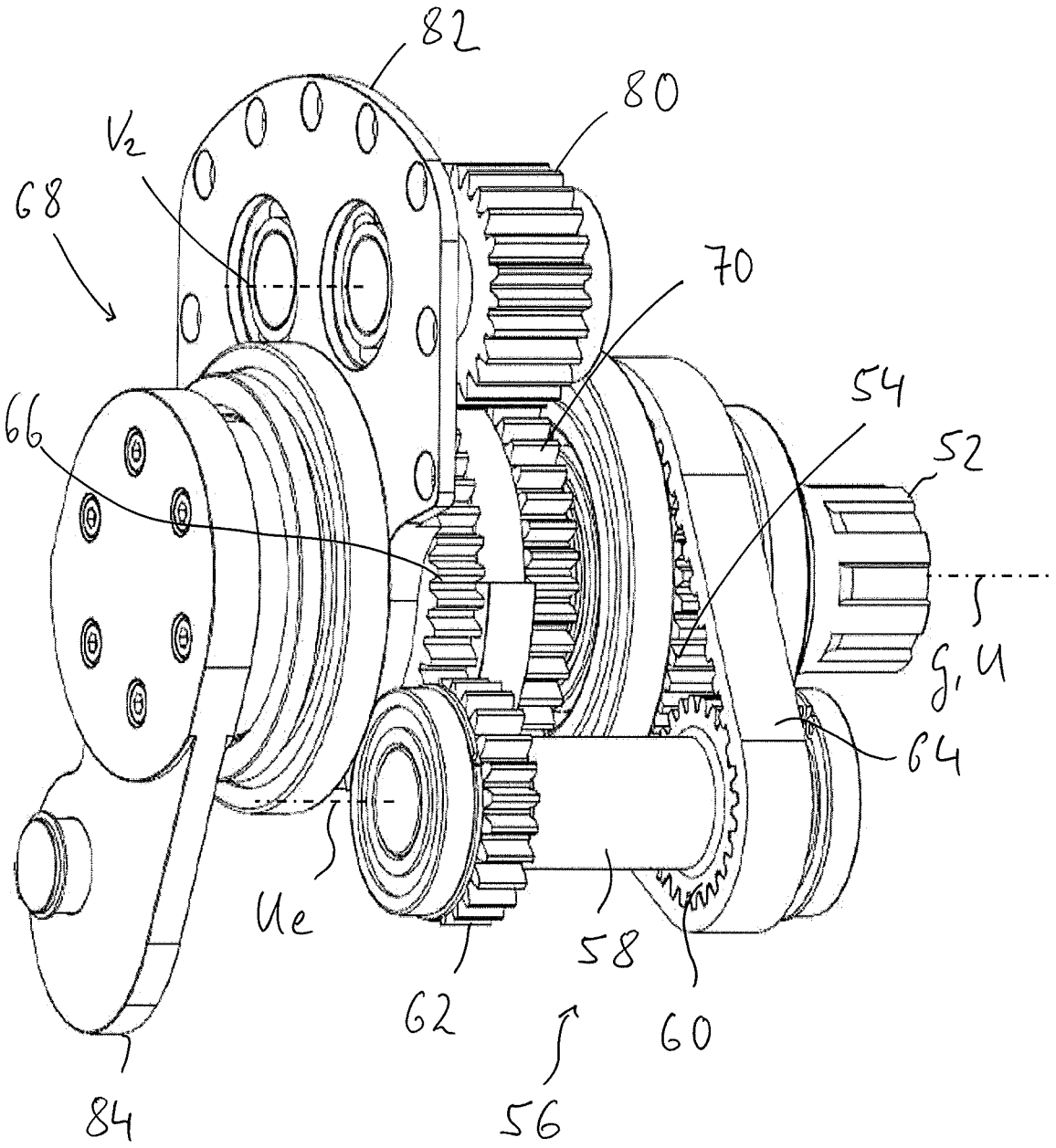
FIG. 4 shows the phase position adjustment arrangement of FIG. 3 with further removed housing parts.
Figure 5:
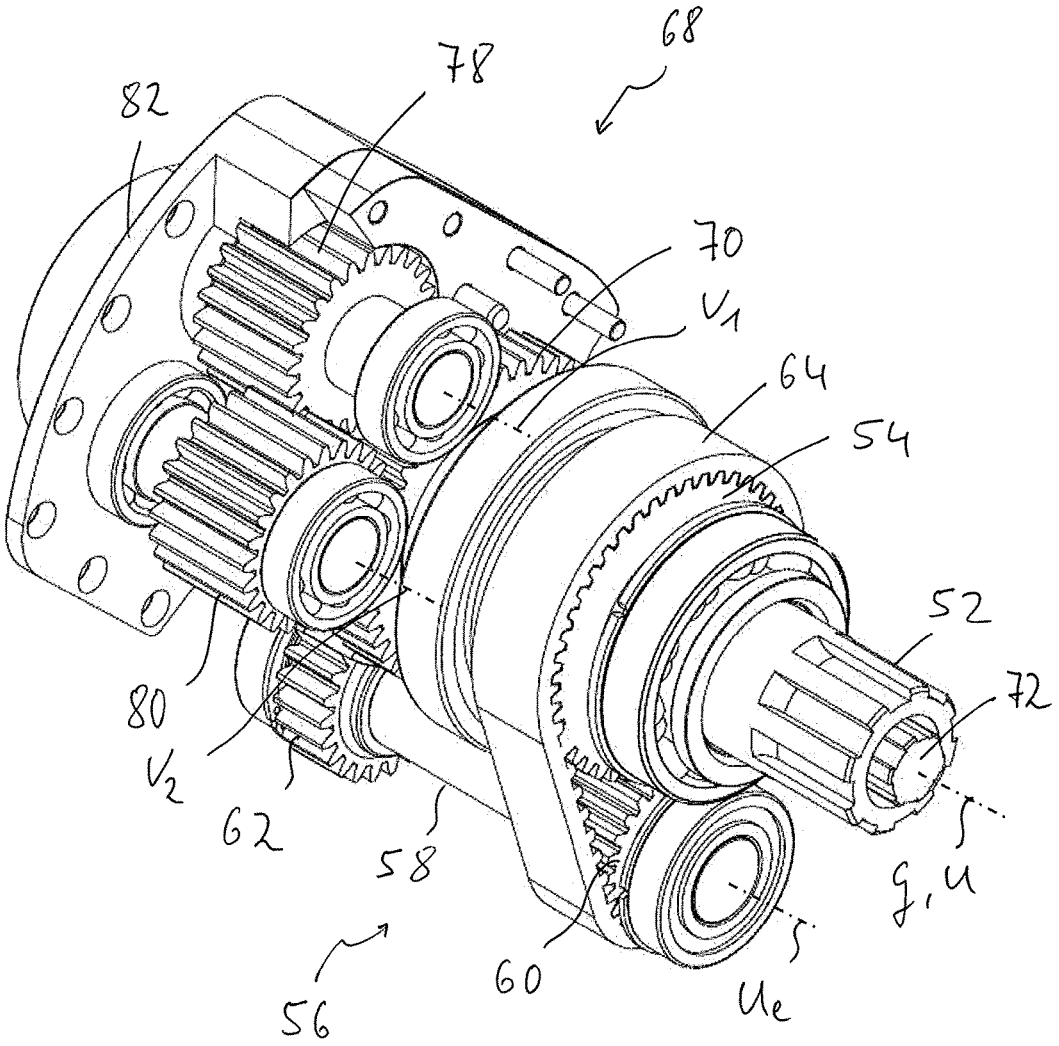
FIG. 5 shows the phase position adjustment unit of FIG. 4, viewed from a different perspective.
Figure 6:
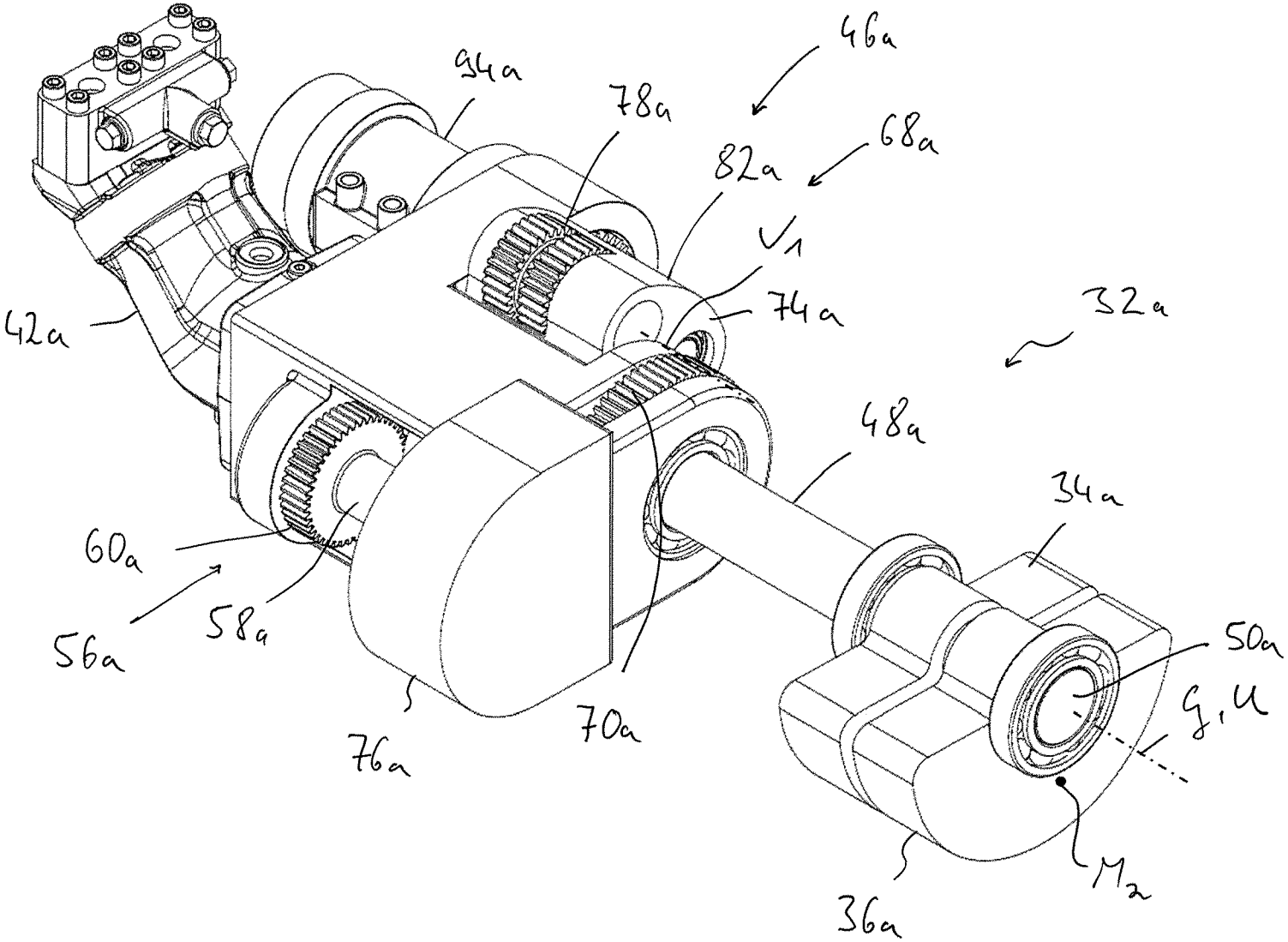
FIG. 6 shows a perspective view of a phase position adjustment unit of another design.
Figure 7:
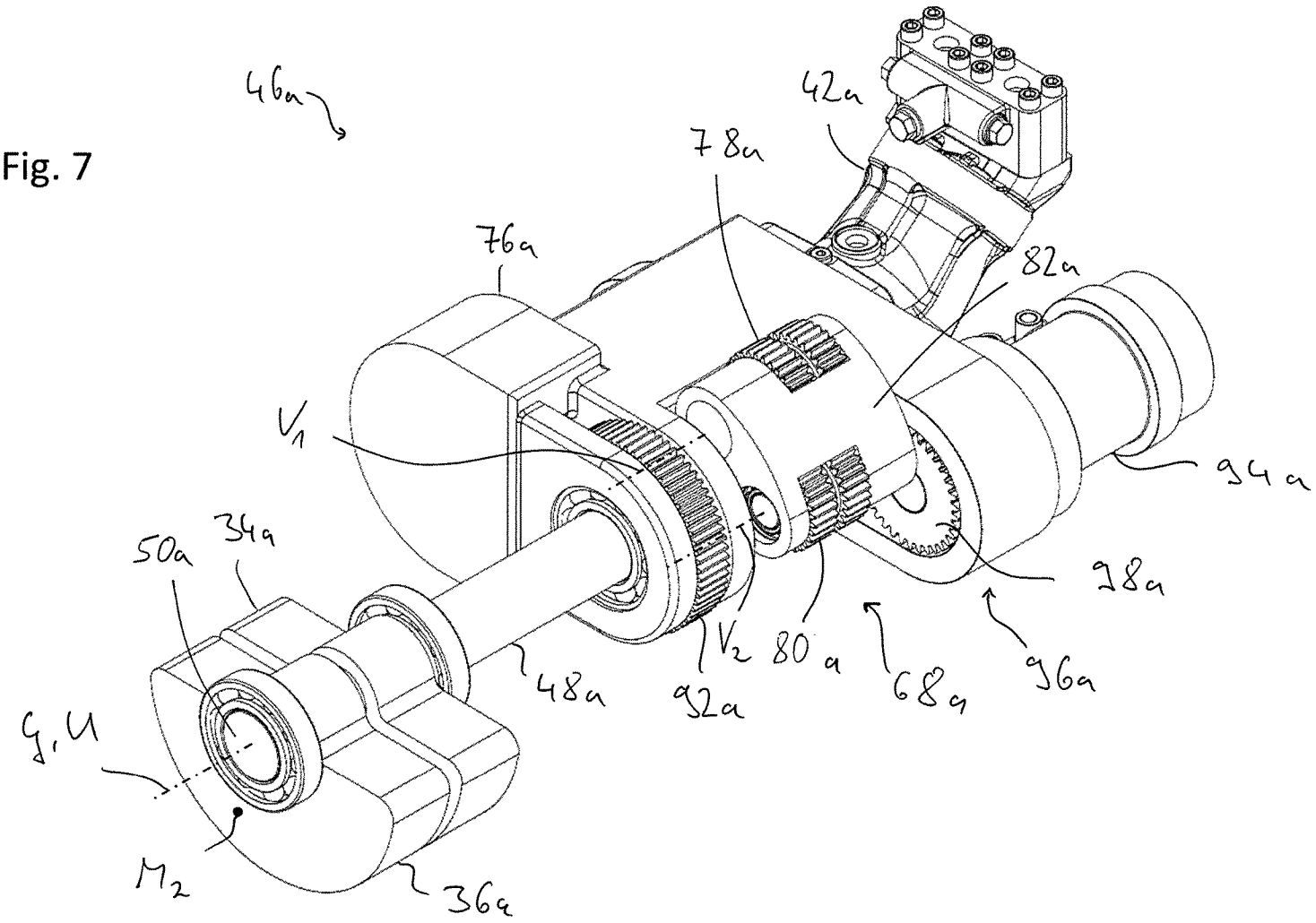
FIG. 7 shows the phase position adjustment unit of FIG. 6, viewed from a different perspective.
Figure 8:
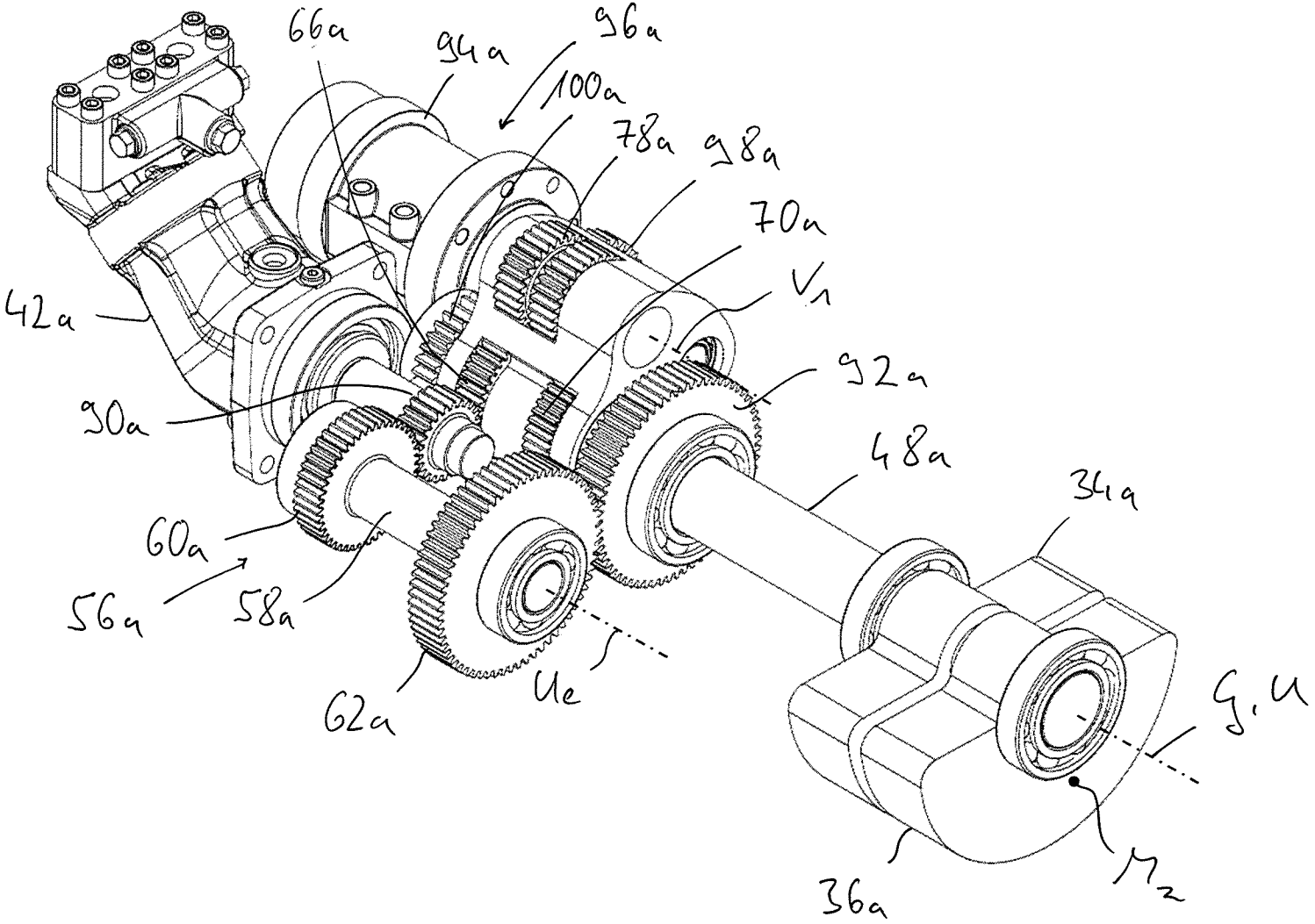
FIG. 8 shows the phase position adjustment unit of FIG. 8 without housing parts partially accommodating it.
Figure 9:
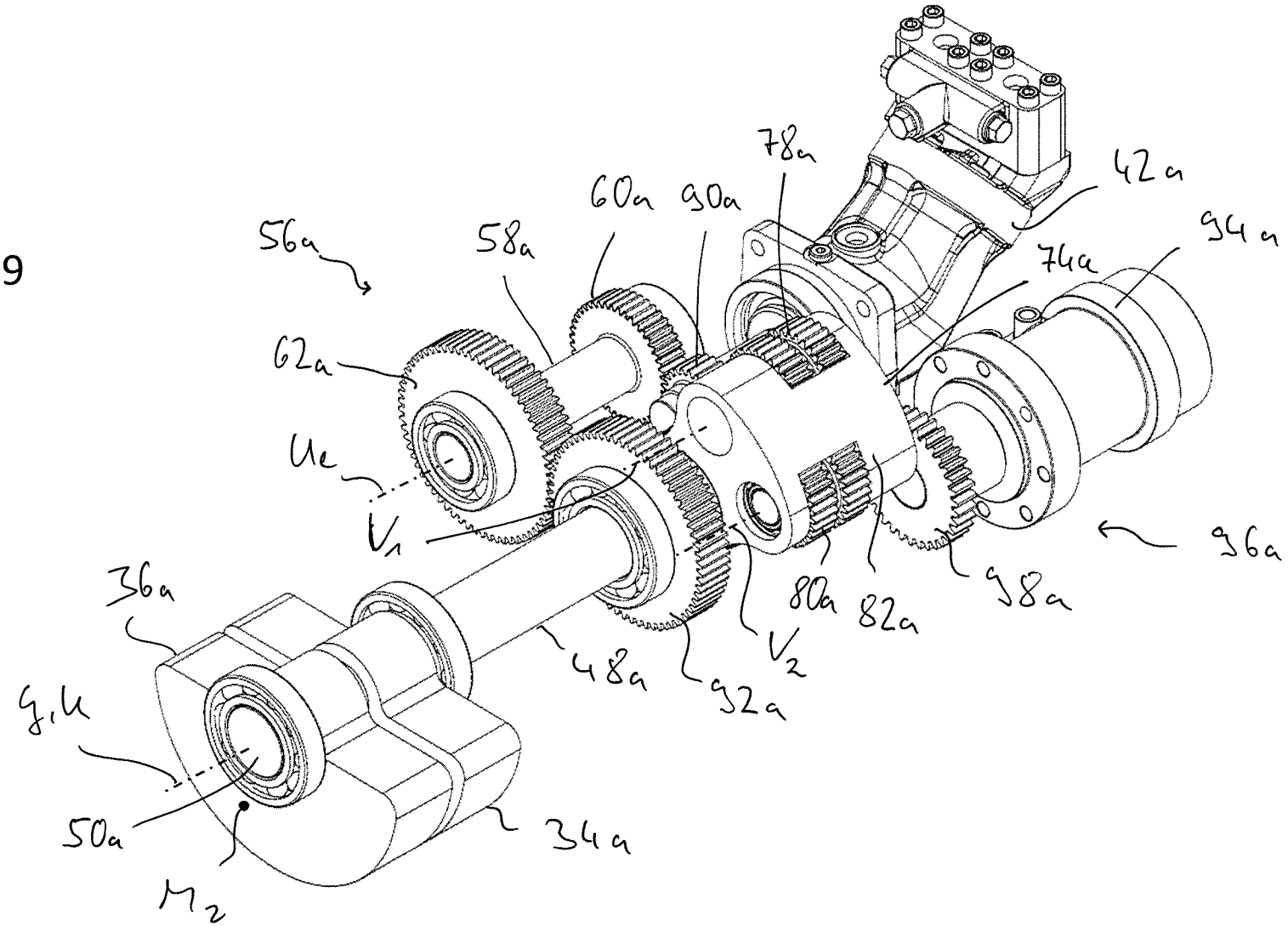
FIG. 9 shows the phase position adjustment unit of FIG. 8, viewed from a different perspective.
Figure 10:
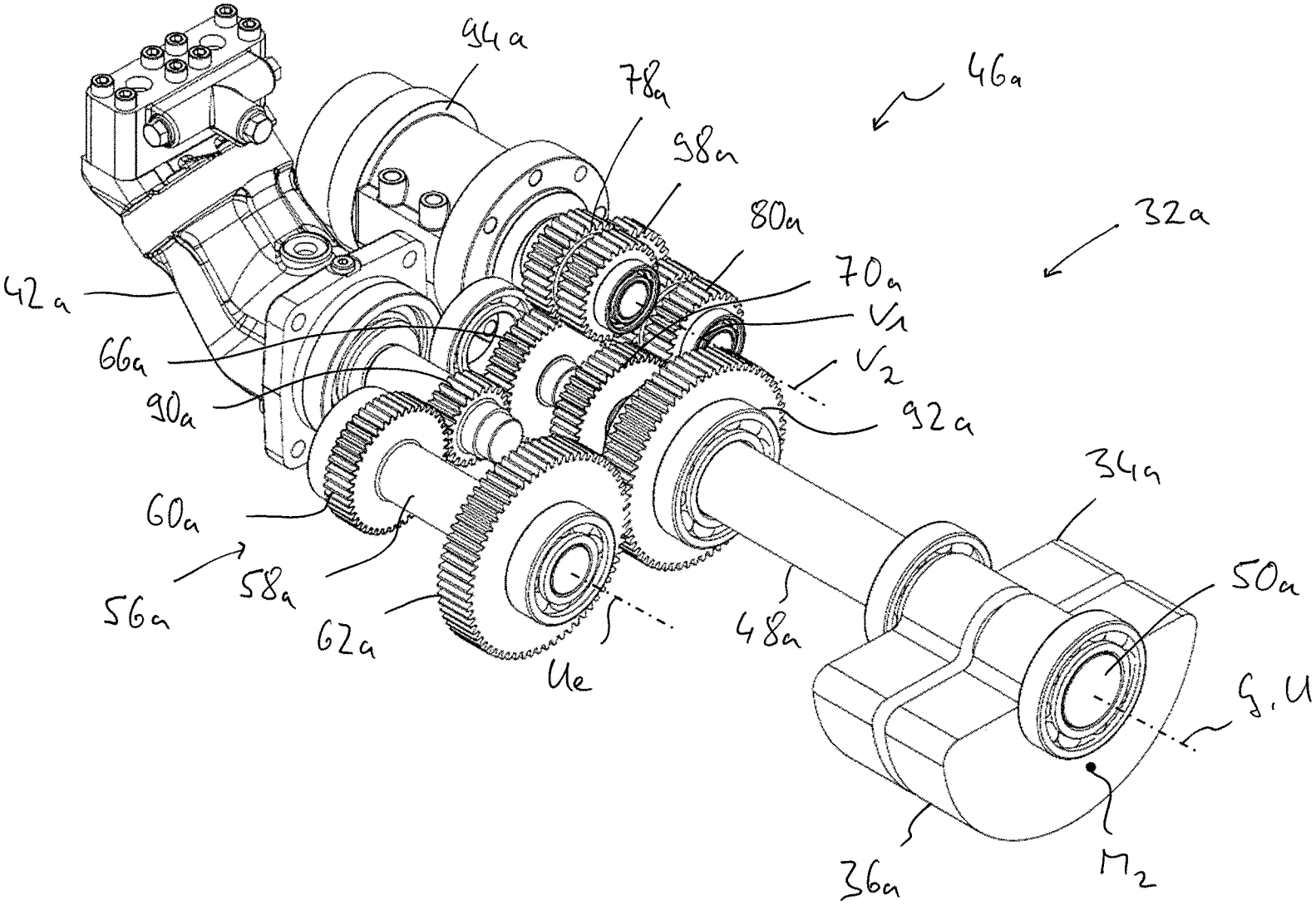
FIG. 10 shows the phase position adjustment unit of FIG. 8 with further housing parts not shown.

The embodiment of the unbalance arrangement shown in FIGS. 2 to 4 is characterized in that the unbalance drive 42 is arranged on a first axial end region 86 of the first unbalance mass unit 34, while the phase position adjustment unit 46 is arranged on a second axial end region 88 of the first unbalance mass unit 34, so that the first unbalance mass unit 34 and thus also the second unbalance mass unit 36 are arranged axially between the unbalance drive 42 and the phase position adjustment unit 46. This results in an approximately equal mass distribution in the axial direction of the various system regions of the unbalance arrangement 32 in the roller interior 26.

With reference to FIGS. 6 to 10, a second embodiment of the unbalance arrangement or the phase position adjustment unit is described below, which is characterized in that all system regions of the unbalance arrangement which are used to drive or to transmit torque or also to adjust the phase position are arranged on the same axial side of the first unbalance mass unit or both unbalance mass units. This results in an axially compact structure.

Components or system regions which correspond to the components or system areas described above are denoted in FIGS. 6 to 10 with the same reference signs with the addition of the suffix "a".

In the embodiment shown in FIGS. 6 to 10, the unbalance drive **42*a*, which can comprise a hydraulic motor, for example, on the one hand drives the first transmission idler wheel 60*a* of the gear transmission unit 56*a* via a motor drive spur gear 90*a*, which can be supported in a rotationally-fixed manner on a motor output shaft 56*a*, to rotate around the transmission axis of rotation Ue, and on the other hand drives the gear input spur gear 66*a* of the spur gear arrangement 68*a* to rotate around the gear axis of rotation G. For this purpose, the motor drive spur gear 90*a* is in meshing engagement with both the first transmission idler spur gear 60*a* and also the gear input spur gear 66*a*. The second transmission idler spur gear 62*a* is in meshing engagement and thus in drive connection with a transmission output spur gear 92*a*, which is coupled to the hollow shaft section 48*a* of the first unbalance mass unit 34*a* for joint rotation around the unbalance axis of rotation U. The unbalance drive 42 thus drives the first unbalance mass unit 34*a* via the gear transmission unit 56*a* to rotate around the unbalance axis of rotation U. The spur gear arrangement 68*a* comprises the first gear adjustment spur gear 78*a* and the second gear adjustment spur gear 80*a* on the adjustment spur gear carrier 82*a* designed as a cassette-like housing 74*a*. In this embodiment, each of the two gear adjustment spur gears 78*a*, 80*a* is designed with two spur gear sections formed axially separated from one another. One of these spur gear sections of the first gear adjustment gear 78*a* is in meshing engagement with the gear input spur gear 66*a*. The other spur gear section of the first gear adjustment spur gear 78*a* is in meshing engagement with one of the two spur gear sections of the second gear adjustment spur gear 80*a*. Its second spur gear section is in meshing engagement with the gear output spur gear 70*a*, which in turn is coupled in a rotationally-fixed manner to the shaft section 50*a* on which the second unbalance mass unit 36*a* is also supported in a rotationally-fixed manner. In this embodiment as well, the unbalance drive 42*a* thus drives the second unbalance mass unit 36*a* to rotate via the spur gear arrangement 68*a***.

In contrast to the embodiment of FIGS. 2 to 5, the unbalance drive 42 in the embodiment of FIGS. 6 to 10 has a direct drive connection with its motor drive spur gear **90*a* to the input region of the spur gear arrangement 68*a*, namely the gear input spur gear 66*a*, and does not drive the first unbalance mass unit 34*a* directly, but rather via the gear transmission unit 56*a*. In this embodiment as well, the arrangement and dimensioning of the various spur gears having drive connections to one another is selected so that the two unbalance mass units 34*a*, 36*a* can basically be driven to rotate by the unbalance drive 42*a*** around the unbalance axis of rotation U, which can also correspond here to the roller axis of rotation, in the same direction of rotation and at the same speed.

By pivoting the adjustment spur gear carrier 82*a* around the gear axis of rotation G, due to the effect of the gear adjustment spur gears 78*a*, 80*a* in meshing engagement with one another, a relative rotation is forced between the gear input spur gear 66*a* and the gear output spur gear 70*a* and accordingly also a relative rotation between the first unbalance mass unit 34*a* and the second unbalance mass unit 36*a*, so that, starting from the relative position or phase position shown in FIGS. 6 to 10, in which the two centers of mass have the same phase position, i.e., have no angular offset with respect to one another, and thus the generated unbalance torque is maximum, these can be pivoted to a relative rotational position or phase position with respect to one another in which the two centers of mass have an angular offset or a phase position of 180° with respect to one another, so that the two unbalance mass units or the unbalances provided thereby compensate for one another and therefore do not exert vibration acceleration on the compactor roller receiving the unbalance arrangement 10*a*.

This adjustment of the adjustment spur gear carrier 82*a* can be achieved in the structure shown in FIGS. 6 to 10 by an adjustment motor 94*a*, for example an electric motor, hydraulic motor, or the like, and a spur gear mechanism 96*a*. The spur gear mechanism 96*a* comprises a first spur gear 98*a*, which is supported in a rotationally-fixed manner on a motor shaft of the adjustment motor 94*a*, and comprises a second spur gear 100*a*, which is supported in a rotationally-fixed manner on the adjustment spur gear carrier 82*a* and thus rotates together with the latter around the gear axis of rotation G when the adjustment motor 94*a* is excited. In this embodiment as well, it is ensured that a rotation or a pivot of the adjustment spur gear carrier 82*a* around the gear axis of rotation G by 90° results in a relative rotation between the gear input spur gear 66*a* and the gear output spur gear 70*a* and thus also a relative rotation between the two unbalance mass units 34*a*, 36*a* of 180°, so that a continuous adjustment between maximum unbalance effect and minimum or non-existent unbalance effect can also be achieved here.

Since in the embodiment according to the invention of an unbalance arrangement, the transmission of the torque between a single unbalance drive and the two unbalance mass units takes place partly directly, partly via a spur gear arrangement or a phase position adjustment unit, in which a torque is exclusively transmitted by spur gears in meshing engagement or coupled to one another via endless transmission elements, a compact structure producible using standard components, which is nevertheless suitable for transmitting very high torques is achieved which, on the one hand, can operate reliably over a long service life, and, on the other hand, enables a continuous adjustment of the unbalance effect or the vibration effect caused by it between a maximum effect when there is no phase offset of the centers of mass of the two unbalance mass units and a minimum effect when there is a phase offset or an angular position of the two unbalance units of mass of 180°.

The invention claimed is:

1. An unbalance arrangement for a compactor roller of a soil compactor, comprising:

a first unbalance mass unit rotatable around an unbalance axis of rotation and having a first center of mass eccentric with respect to the unbalance axis of rotation, a second unbalance mass unit rotatable around the unbalance axis of rotation and having a second center of mass eccentric with respect to the unbalance axis of rotation, an unbalance drive for jointly driving the first unbalance mass unit and the second unbalance mass unit to rotate around the unbalance axis of rotation, a phase position adjustment unit for adjusting a phase position of the first center of mass with respect to the second center of mass around the unbalance axis of rotation, wherein the phase position adjustment unit comprises a spur gear arrangement in a torque transmission path between the unbalance drive and the first unbalance mass unit or the second unbalance mass unit, wherein the spur gear arrangement comprises a gear input spur gear drivable by the unbalance drive to rotate around a gear axis of rotation, a gear output spur gear rotatable around the gear axis of rotation, and a group of gear adjustment spur gears in meshing engagement with the gear input spur gear and the gear output spur gear, wherein the gear adjustment spur gears are rotatably supported on an adjustment spur gear carrier, and wherein the adjustment spur gear carrier is rotatable with respect to the gear input spur gear and the gear output spur gear around the gear axis of rotation, wherein the group of adjustment spur gears comprises a first adjustment spur that is rotatable around a first adjustment spur gear axis of rotation that is parallel to the gear axis of rotation and is in meshing engagement with the gear input spur gear, and a second adjustment spur that is rotatable around a second adjustment spur gear axis of rotation that is parallel to the gear axis of rotation and is in meshing engagement with the first adjustment spur gear and the gear output spur gear.

2. The unbalance arrangement according to claim 1, wherein the adjustment spur gear carrier is assigned an adjustment spur gear carrier drive for pivoting the adjustment spur gear carrier around the gear axis of rotation.

3. The unbalance arrangement according to claim 1, wherein the gear axis of rotation corresponds to the unbalance axis of rotation.

4. The unbalance arrangement according to claim 1, wherein the gear output spur gear is coupled to the second unbalance mass unit for joint rotation.

5. The unbalance arrangement according to claim 4, wherein the gear input spur gear is drivable to rotate using the unbalance drive via the first unbalance mass unit, and/or in that the first unbalance mass unit and the second unbalance mass unit are arranged axially between the unbalance drive and the phase position adjustment unit.

6. The unbalance arrangement according to claim 5, wherein the first unbalance mass unit is coupled in a first axial end region to the unbalance drive for driving the first unbalance mass unit for rotation around the unbalance axis of rotation, and in that the first unbalance mass unit has a drive connection in a second axial end region by means of a gear transmission unit to the gear input spur gear.

7. The unbalance arrangement according to claim 6, wherein the gear transmission unit comprises:

a transmission drive spur gear coupled to the second axial end region of the first unbalance mass unit for joint rotation around the unbalance axis of rotation, a first transmission idler spur gear on a transmission shaft rotatable around a gear axis of rotation parallel to the unbalance axis of rotation, wherein the first transmission idler spur gear has a drive connection to the transmission drive spur gear, a second transmission idler spur gear on the transmission shaft, wherein the second transmission spur gear has a drive connection to the transmission input spur gear.

8. The unbalance arrangement according to claim 7, wherein the first transmission idler spur gear and the second transmission idler spur gear are supported in a rotationally-fixed manner on the transmission shaft.

9. The unbalance arrangement according to claim 7, wherein the first transmission idler spur gear has a drive connection to the transmission drive spur gear by means of an endless transmission element and/or at least one connecting spur gear, and/or in that the second transmission idler spur gear is in meshing engagement with the gear input spur gear.

10. The unbalance arrangement according to claim 9, wherein the endless transmission element comprises a toothed belt or a drive chain.

11. The unbalance arrangement according to claim 4, wherein the gear input spur gear has a drive connection to a motor drive spur gear.

12. The unbalance arrangement according to claim 11, wherein the unbalance drive and the phase position adjustment unit are arranged on the same axial side with respect to the first unbalance mass unit and the second unbalance mass unit.

13. The unbalance arrangement according to claim 11, wherein the gear input spur gear is in meshing engagement with the motor drive spur gear, and/or in that the motor drive spur gear is provided on a drive shaft of the unbalance drive.

14. The unbalance arrangement according to claim 11, wherein the first unbalance mass unit has a drive connection to the motor drive spur gear by means of a gear transmission unit.

15. The unbalance arrangement according to claim 14, wherein the gear transmission unit comprises:

a first transmission idler spur gear on a transmission shaft rotatable around a gear axis of rotation parallel to the unbalance axis of rotation, wherein the first transmission idler spur gear has a drive connection to the motor spur gear, a second transmission idler spur gear on the transmission shaft, a transmission output spur gear coupled to the first unbalance mass unit for joint rotation around the unbalance axis of rotation, wherein the transmission output spur gear has a drive connection to the second transmission idler spur gear.

16. The unbalance arrangement according to claim 15, wherein the first transmission idler spur gear and the second transmission idler spur gear are supported in a rotationally-fixed manner on the transmission shaft.

17. The unbalance arrangement according to claim 15, wherein the first transmission idler spur gear is in meshing engagement with the motor drive spur gear, and/or in that the second transmission idler spur gear is in meshing engagement with the transmission output spur gear.

18. A compactor roller for a soil compactor, comprising a roller shell surrounding a roller axis of rotation, wherein an unbalance arrangement according to claim 1 is provided in a roller interior.

19. The compactor roller according to claim 18, wherein the roller axis of rotation corresponds to the unbalance axis of rotation.

20. A soil compactor, comprising at least one compactor roller according to claim 18 which is rotatably supported on a compactor frame around a roller axis of rotation.

* * * * *